US007626320B2

(12) United States Patent
Shibata

(10) Patent No.: US 7,626,320 B2
(45) Date of Patent: Dec. 1, 2009

(54) SPARK PLUG WITH EXCELLENT IMPACT RESISTANCE CONDUCTIVE SEAL, AND METHOD FOR PRODUCING THE SAME

(75) Inventor: Tsutomu Shibata, Owariasahi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 564 days.

(21) Appl. No.: 10/554,101

(22) PCT Filed: May 14, 2004

(86) PCT No.: PCT/JP2004/006875

§ 371 (c)(1),
(2), (4) Date: Oct. 21, 2005

(87) PCT Pub. No.: WO2004/105203

PCT Pub. Date: Dec. 2, 2004

(65) Prior Publication Data

US 2006/0220510 A1 Oct. 5, 2006

(30) Foreign Application Priority Data

May 20, 2003 (JP) ..... 2003-142415

(51) Int. Cl.
*H01T 13/00* (2006.01)

(52) U.S. Cl. ..... 313/144; 313/118; 313/137

(58) Field of Classification Search ..... 313/118–145; 123/169 R, 169 EL, 32, 41, 310
See application file for complete search history.

(56) References Cited

U.S. PATENT DOCUMENTS

| | | | | |
|---|---|---|---|---|
| 4,006,106 | A * | 2/1977 | Yoshida et al. | 252/513 |
| 6,188,166 | B1 * | 2/2001 | Nishikawa et al. | 313/141 |
| 6,583,537 | B1 * | 6/2003 | Honda et al. | 313/136 |
| 2003/0127959 | A1 | 7/2003 | Nishikawa et al. | |

FOREIGN PATENT DOCUMENTS

| | | | |
|---|---|---|---|
| EP | 961373 | A1 | 12/1999 |
| EP | 1271725 | A2 * | 1/2003 |
| JP | 51-27639 | A | 3/1976 |
| JP | 3-173087 | A | 7/1991 |
| JP | 11-339925 | A | 12/1999 |
| KR | 2003-0001351 | A | 1/2003 |

* cited by examiner

*Primary Examiner*—Sikha Roy
*Assistant Examiner*—Jose M Diaz
(74) *Attorney, Agent, or Firm*—Sughrue Mion, PLLC

(57) ABSTRACT

An object of the present invention is to provide a spark plug which has more excellent impact resistance with electrical conductivity and airtightness kept excellent. In the invention, each of first and second electrically conductive sealing layers (17) and (19) is made of electrically conductive glass containing a glass component and a metal component. The metal component at least contains a Cu—Zn alloy which contains Cu as a first component, and Zn as a second component.

17 Claims, 3 Drawing Sheets

SPARK PLUG WITH EXCELLENT IMPACT RESISTANCE CONDUCTIVE SEAL, AND METHOD FOR PRODUCING THE SAME

TECHNICAL FIELD

The present invention relates to a spark plug and a method for producing the same.

BACKGROUND ART

A spark plug described in Patent Document 1 has been heretofore known. The spark plug has a cylindrical metal shell. An insulator, which is formed cylindrically by a through-hole so as to extend in the axial direction of the metal shell, is fixed to the inside of the metal shell. A center electrode and a terminal attachment are provided in the inside of the metal shell and the insulator. The center electrode extends in the axial direction of the metal shell and has an electrically dischargeable front end protruding from a front end of the insulator, and a rear end fixed into the through-hole. The terminal attachment extends in the axial direction of the metal shell and has a rear end protruding from the rear end of the insulator, and a front end fixed into the through-hole. An end of a ground electrode is fixed to the metal shell so that a spark discharge gap is formed between the ground electrode and the center electrode.

The spark plug has an electrically conductive connection layer which is provided in the through-hole of the insulator and between the center electrode and the terminal attachment so that the center electrode and the terminal attachment are electrically connected to each other by the electrically conductive connection layer. The electrically conductive connection layer has a first electrically conductive sealing layer, a resistor and a second electrically conductive sealing layer which are arranged in order when viewed from the center electrode side. There is description that each of the first and second electrically conductive sealing layers is made of electrically conductive glass which contains a glass component, and a metal component, and that Cu can be used as an example of the metal component. Besides the spark plug configured as described above, a spark plug having an electrically conductive connection layer made of a combination of an electrically conductive sealing layer and a resistor arranged in order viewed from the center electrode side and a spark plug having an electrically conductive connection layer made of only an electrically conductive sealing layer have been known.

When this type spark plug is mounted in an engine and a high voltage is applied between the metal shell and the terminal attachment, electric discharge is generated in the spark discharge gap between the center electrode and the ground electrode to thereby perform ignition at the time of driving the engine. On this occasion, in the spark plug in which Cu is used as an example of the metal component of the electrically conductive glass in the electrically conductive sealing layers (first and second electrically conducive sealing layers described in Patent Document 1), the terminal attachment and the center electrode are fixed to the insulator while airtightness is kept by the glass component. In the spark plug, contact resistance between each of the terminal attachment and the center electrode and the electrically conductive connection layer is reduced by Cu to thereby keep excellent electric conductivity therebetween.

[Patent Document 1]

Japanese Patent Laid-Open No. 127530/1977

DISCLOSURE OF THE INVENTION

In the spark plug, it is however important that a space between each of the terminal attachment and the center electrode and the inner circumferential surface of the through-hole of the insulator is filled with electrically conductive glass sufficiently to obtain a good bonding strength of the electrically conductive sealing layer with each of the terminal attachment and the center electrode. That is, if filling with electrically conductive glass is insufficient because the space is narrow, adhesive force between each of the terminal attachment and the center electrode and the electrically conductive sealing layer becomes so insufficient that there is a possibility that the boundary between each of the terminal attachment and the center electrode and the electrically conductive sealing layer will be peeled off when impact or the like is applied.

In this respect, it may be conceived that Zn, Sn or the like is used in combination with Cu as the metal component of the electrically conductive glass as described in Japanese Patent Laid-Open No. 339925/1999. In such a spark plug, the boundary between each of the terminal attachment and the center electrode and the electrically conductive sealing layer can be prevented from being peeled off by impact or the like while the same electric conductivity and airtightness as in the background art can be kept.

When the aforementioned spark plug is used in a high-output engine or the like, stronger impact may be however applied on the spark plug. Even in this case, it is necessary to prevent peeling from occurring at the boundary between each of the inner circumferential surface of the through-hole of the insulator, the terminal attachment and the center electrode and the electrically conductive sealing layer. It is also necessary to prevent the electrically conductive sealing layer per se from cracking, fissuring, etc.

The present invention is designed upon such circumstances in the background art, and an object of the invention is to provide a spark plug which has more excellent impact resistance with electrical conductivity and airtightness kept excellent, and a method for producing the same.

The present inventors have made research eagerly to solve the aforementioned problem. It has been found that the problem can be solved when a spark plug is improved so that Cu and Zn are used as metal components of electrically conductive glass in first and second electrically conductive sealing layers. Thus, the invention is accomplished.

That is, according to the invention, there is provided a spark plug including an insulator having a through-hole formed in an axial direction, a terminal attachment disposed on one end side of the insulator, a center electrode disposed on the other end side of the insulator, and an electrically conductive connection layer disposed in the through-hole for electrically connecting the terminal attachment and the center electrode to each other, the electrically conductive connection layer including at least one electrically conductive sealing layer connected to at least one of the terminal attachment and the center electrode, the spark plug being characterized in that the electrically conductive sealing layer is made of electrically conductive glass containing a glass component, and a metal component which at least contains a Cu—Zn alloy.

In the spark plug according to the invention, the glass component of the electrically conductive glass in the electrically conductive sealing layer contains a Cu—Zn alloy. Such a Cu—Zn alloy can keep electrical conductivity and airtightness excellent. The electrically conductive glass containing the Cu—Zn alloy can suppress peeling from occurring in the boundary between each of the inner circumferential surface of the through-hole of the insulator, the terminal attachment and the center electrode and the electrically conductive sealing layer. In addition, the electrically conductive glass can suppress cracking, fissuring, etc. from occurring in the electrically conductive sealing layer per se. For this reason, the spark plug is excellent in impact resistance.

Accordingly, in the spark plug according to the invention, impact resistance can be made more excellent while electrical conductivity and airtightness can be kept excellent.

Incidentally, in the spark plug according to the invention, the electrically conductive sealing layer can be formed so as to be connected to at least one of the terminal attachment and the center electrode. The electrically conductive connection layer may be constituted by an electrically conductive sealing layer as a whole or may be constituted by a resistor and electrically conductive sealing layers located at opposite ends of the resistor in the same manner as in the background art. All the metal component contained in the electrically conductive sealing layer may be a Cu—Zn alloy or part of the metal component may be a Cu—Zn alloy. When part of the metal component is a Cu—Zn alloy, at least one member selected from Cu, Fe, Sb, Sn, Ag, Al, Ni and alloys thereof may be used as the other part of the metal component.

Preferably, the Cu—Zn alloy contains Cu as a first component, and Zn as a second component. That is, it is preferable that a largest amount of Cu and a second largest amount of Zn are contained in the Cu—Zn alloy. The Cu—Zn alloy may contain inevitable impurities other than Cu and Zn. In this case, it is preferable that the total amount of Cu and Zn is not smaller than 99 mass %.

Preferably, in the spark plug according to the invention, substantially all Zn contained in the metal component is alloyed. The inventors have confirmed that there is a possibility that impact resistance of the electrically conductive sealing layer may be lowered if a non-alloyed Zn component is contained in the metal component.

Incidentally, the phrase "substantially all Zn contained in the metal component is alloyed" means the case where there is no non-alloyed Zn component detected when the non-alloyed Zn component (single Zn component) in the metal component in the electrically conductive sealing layer is measured by X-ray diffraction. The term "non-alloyed Zn component (single Zn component)" means that the amount of Zn is not smaller than 99 wt % and the residual part is inevitable impurities other than Cu.

In addition, according to the invention, there is provided a method of producing a spark plug including an insulator having a through-hole formed in an axial direction, a terminal attachment disposed on one end side of the insulator, a center electrode disposed on the other end side of the insulator, and an electrically conductive connection layer disposed in the through-hole for electrically connecting the terminal attachment and the center electrode to each other, the electrically conductive connection layer including at least one electrically conductive sealing layer connected to at least one of the terminal attachment and the center electrode, the method being characterized by including the steps of: filling the through-hole of the insulator with electrically conductive glass powder containing glass powder and metal powder containing at least Cu—Zn alloy powder; and softening the electrically conductive glass powder to form the electrically conductive sealing layer.

In the method of producing a spark plug according to the invention, the through-hole of the insulator is filled with electrically conductive glass powder containing glass powder and metal powder containing Cu—Zn alloy powder. The electrically conductive glass powder is softened to form the electrically conductive sealing layer. In a method of adding Cu powder and Zn powder separately and then alloying Cu and Zn by heat treatment or the like, it is difficult to obtain a Cu—Zn alloy with a desired ratio in the electrically conductive sealing layer in accordance with the heat treatment condition and the mixture state. When Cu—Zn alloy powder alloyed in advance as described above is used, the Cu—Zn alloy in a desired ratio can be contained in the metal component of the electrically conductive glass in the electrically conductive sealing layer formed. Accordingly, in the spark plug formed by the production method according to the invention, impact resistance can be made more excellent while electrical conductivity and airtightness can be kept excellent.

Preferably, the electrically conductive glass powder contains the metal powder larger than 30 mass % and smaller than 75 mass %. According to the inventor's examination, impact resistance of the spark plug may be insufficient if the amount of the metal powder is not larger than 30 mass %. If the amount of the metal powder is not smaller than 75 mass %, there is a possibility that airtightness may be lowered because the amount of the glass component becomes small. For this reason, when the electrically conductive glass powder contains the metal powder larger than 30 mass % and smaller than 75 mass %, the electrical conductivity and airtightness of the spark plug formed can be kept so that impact resistance of the spark plug can be improved.

Preferably, the metal powder contains the Cu—Zn alloy powder larger than 10 mass %. When the metal powder contains the Cu—Zn alloy powder larger than 10 mass %, the electrical conductivity, airtightness and impact resistance of the spark plug can be kept effectively. Incidentally, according to the inventor's examination, impact resistance of the spark plug may be insufficient if the metal powder contains the Cu—Zn alloy powder not larger than 10 mass %. More preferably, the metal powder contains the Cu—Zn alloy powder larger than 50 mass %. When the metal powder contains the Cu—Zn alloy powder larger than 50 mass %, impact resistance can be improved more effectively while the electrical conductivity and airtightness of the spark plug formed can be kept.

Preferably, in the method of producing a spark plug according to the invention, no Zn powder is contained. The inventors have confirmed that the impact resistance of the spark plug formed is lowered because Zn powder not alloyed in the electrically conductive glass layer remains in the final product if the Zn component is mixed in a state of Zn powder, that is, in a state in which the Zn component is not alloyed. Accordingly, it is preferable that all the Zn component is alloyed before added.

Preferably, the Cu—Zn alloy powder contains 5-40 mass % of Zn. The inventors have confirmed the effect of the invention with respect to the Cu—Zn alloy powder containing 5-40 mass % of Zn.

Preferably, in the spark plug according to the invention, the electrically conductive glass powder contains inorganic oxide of semiconductor as at least one member selected from In, Sn, Cr, V and Ti. According to the inventors' examination, when configuration is made as described above, impact resistance can be improved more greatly while electrical conductivity and airtightness of the electrically conductive sealing layer can be kept. Indium oxide ($In_2O_3$), tin oxide ($SnO_2$), chromium oxide ($Cr_2O_3$), vanadium oxide ($V_2O_3$, $VO_2$), titanium oxide ($TiO_2$) or the like can be used as the semiconductor inorganic oxide. According to the inventors' examination, it is preferable that the amount of the semiconductor inorganic oxide is smaller than 10 parts by mass when the total amount of the glass powder and the metal powder is 100 parts by mass. If the amount of the semiconductor inorganic oxide is not smaller than 10 parts by mass, there is a possibility that airtightness may be lowered.

Preferably, the mean particle size of the metal powder is not smaller than 5 μm and not larger than 40 μm. If the mean particle size of the metal powder is smaller than 5 μm, cost increases because the particle size is too small to obtain good production efficiency. On the other hand, if the mean particle size of the metal powder is larger than 40 μm, there is a possibility that the impact resistance of the spark plug formed may be lowered.

Figure 1:
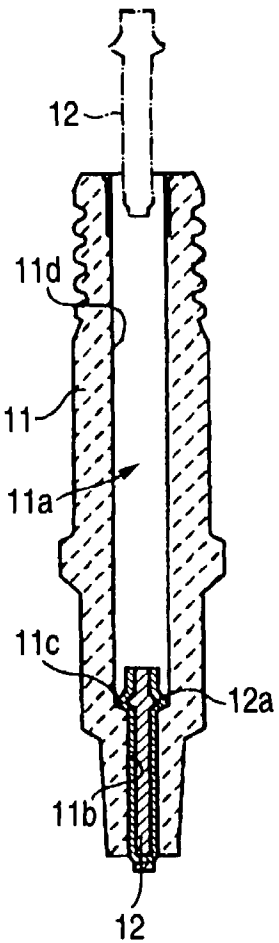
FIG. 1 is a vertical sectional view of an insulator in a production process according to an embodiment.
Figure 1:
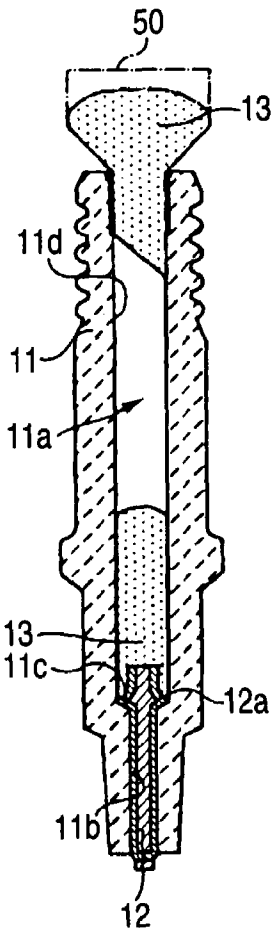
Figure 1:
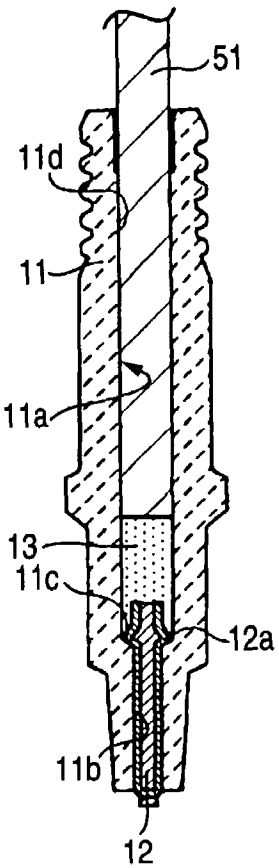
Figure 1:
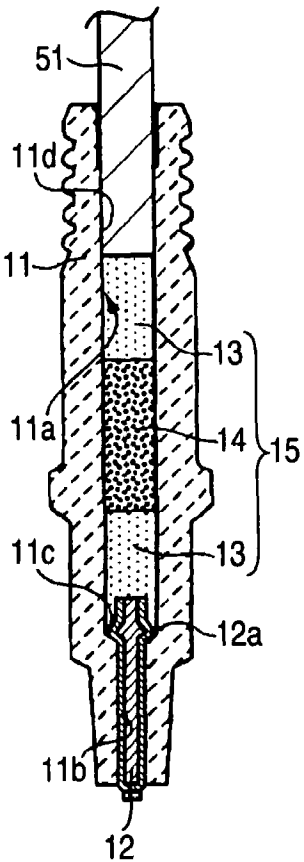

Incidentally, reference numerals in the drawings are as follows.

20 . . . metal shell
11*a* . . . through-hole
11 . . . insulator
12 . . . center electrode
16 . . . terminal attachment
13*a*, 13*b* . . . electrically conductive glass
17 . . . first electrically conductive sealing layer
19 . . . second electrically conductive sealing layer
21 . . . ground electrode
18 . . . resistor

BEST MODE FOR CARRYING OUT THE INVENTION

An embodiment for embodying a spark plug according to the present invention will be described with reference to the drawings.

The spark plug according to this embodiment can be produced as follows. First, as shown in FIG. 1(*a*), a center electrode 12 having a flange portion 12*a* on its rear end side is prepared. A nearly cylindrical insulator 11 made of a sintered body of ceramics such as alumina etc. and having a through-hole 11*a* in an axial direction is prepared. The through-hole 11*a* of the insulator 11 includes a first through-hole 11*b* having a small diameter and piercing the insulator 11 on a front end side, a taper portion 11*c* for enlarging the diameter of the first through-hole 11*b*, and a second through-hole 11*d* extending from the taper portion 11*c* and piercing the insulator 11 on a rear end side. The center electrode 12 is inserted into the insulator 11 from the rear end side of the through-hole 11*a* so as to be moved into the first through-hole 11*b* of the through-hole 11*a* via the second through-hole 11*d*. Thus, the flange portion 12*a* of the center electrode 12 is stopped in the first through-hole 11*b* by the taper portion 11*c*, so that the center electrode 12 is stopped. On this occasion, a front end of the center electrode 12 protrudes from a front end of the insulator 11.

Then, as shown in FIG. 1(*b*), a funnel 50 is inserted into the rear end of the through-hole 11*a* of the insulator 11. Electrically conductive glass powder 13 is injected into the through-hole 11*a* through the funnel 50. The electrically conductive glass powder 13 is prepared as a blend of glass power and metal powder in a mixture ratio (mass %) shown in each of Test Samples 1 to 25 shown in Table 1.

TABLE 1

| Test Sample | Amount of Glass Powder Added (mass %) | Amount of Metal Powder Added (mass %) | Composition of Metal Powder: Component | Amount Added (mass %) | Another Component | Amount Added (mass %) | Amount of Inorganic Oxide of Semiconductor Added (mass %) |
|---|---|---|---|---|---|---|---|
| 1 | 50 | 50 | Cu (powder) | 100 | — | — | — |
| 2 | 50 | 50 | Cu (powder) | 90 | Zn (powder) | 10 | — |
| 3 | 50 | 50 | Cu•10Zn | 100 | — | — | — |
| 4 | 50 | 50 | Cu•10Zn | 75 | Cu (powder) | 25 | — |
| 5 | 50 | 50 | Cu•10Zn | 50 | Cu (powder) | 50 | — |
| 6 | 50 | 50 | Cu•10Zn | 25 | Cu (powder) | 75 | — |
| 7 | 50 | 50 | Cu•10Zn | 15 | Cu (powder) | 85 | — |
| 8 | 50 | 50 | Cu•10Zn | 10 | Cu (powder) | 90 | — |
| 9 | 50 | 50 | Cu•5Zn | 100 | — | — | — |
| 10 | 50 | 50 | Cu•25Zn | 100 | — | — | — |
| 11 | 50 | 50 | Cu•40Zn | 100 | — | — | — |
| 12 | 70 | 30 | Cu•10Zn | 100 | — | — | — |
| 13 | 65 | 35 | Cu•10Zn | 100 | — | — | — |
| 14 | 35 | 65 | Cu•10Zn | 100 | — | — | — |
| 15 | 30 | 70 | Cu•10Zn | 100 | — | — | — |
| 16 | 25 | 75 | Cu•10Zn | 100 | — | — | — |
| 17 | 50 | 50 | Cu•10Zn | 100 | — | — | 1.0 $SnO_2$ |

TABLE 1-continued

| Test Sample | Amount of Glass Powder Added (mass %) | Amount of Metal Powder Added (mass %) | Composition of Metal Powder: Component | Amount Added (mass %) | Another Component | Amount Added (mass %) | Amount of Inorganic Oxide of Semiconductor Added (mass %) |
|---|---|---|---|---|---|---|---|
| 18 | 50 | 50 | Cu•10Zn | 100 | — | — | 2.5 $SnO_2$ |
| 19 | 50 | 50 | Cu•10Zn | 100 | — | — | 5.0 $SnO_2$ |
| 20 | 50 | 50 | Cu•10Zn | 100 | — | — | 10.0 $SnO_2$ |
| 21 | 50 | 50 | Cu•10Sn | 100 | — | — | — |
| 22 | 50 | 50 | Cu•20Sn | 100 | — | — | — |
| 23 | 50 | 50 | Cu•7Al | 100 | — | — | — |
| 24 | 50 | 50 | Cu•10Al | 100 | — | — | — |
| 25 | 50 | 50 | Cu•30Ni | 100 | — | — | — |

The glass powder is made of soda borosilicate glass containing 60 mass % of $SiO_2$, 30 mass % of $B_2O_3$, 5 mass % of $Na_2O$, and 5 mass % of BaO.

The composition of the metal power is as follows. In Test Sample 1, Cu powder is used as the metal powder. In Test Sample 2, mixture powder composed of Cu powder and Zn powder is used as the metal powder. In each of Test Samples 3 to 20, powder of a Cu—Zn alloy shown in the "Component" column in Table 1 is used as a metal component. Each Cu—Zn alloy powder contains Cu as a first component, and Zn as a second component. In each of Test Samples 4 to 8, the metal powder is prepared as a mixture of 75-10 mass % of Cu—Zn alloy powder and 25-90 mass % of Cu powder as another component. In Test Sample 21 or 22, powder of a Cu—Sn alloy shown in the "Component" column in Table 1 is used as the metal powder. In Test Sample 23 or 24, powder of a Cu—Al alloy shown in the "Component" column in Table 1 is used as the metal powder. In Test Sample 25, powder of a Cu—Ni alloy shown in the "Component" column in Table 1 is used as the metal powder.

In each of Test Samples 17 to 20, 1.0-10.0 parts by mass of $SnO_2$ as inorganic oxide of semiconductor are added to 100 parts by mass of the electrically conductive glass powder 13 as a mixture of glass powder and metal power.

Then, as shown in FIG. 1(*c*), in each of Test Samples 1 to 25, the electrically conductive glass powder 13 injected into the through-hole 11*a* of the insulator 11 and on the rear end side of the center electrode 12 is preparatorily compressed by a pressure rod 51 which is inserted into the through-hole 11*a* from the rear end of the through-hole 11*a*.

Then, as shown in FIG. 1(*d*), resistor material powder 14 is injected into the through-hole 11*a* of the insulator 11 in the same manner as the aforementioned electrically conductive glass powder 13. On this occasion, the resistor material powder 14 is powder prepared by mixing glass powder, ceramic powder, metal powder (mainly containing one member or two or more members selected from Zn, Sb, Sn, Ag, Ni, etc.), non-metal electrically conductive substance powder (mainly containing one member or two or more members selected from amorphous carbon, graphite, etc.), an organic binder and so on in predetermined proportion and sintering the mixture by hot pressing or the like. Specifically, the resistor material powder 14 can be prepared by mixing 30 mass % of fine glass powder, 60 mass % of $ZrO_2$ powder, 1 mass % of Al powder, 6 mass % of carbon black and 3 mass % of dextrine. The resistor material powder 14 disposed in the through-hole 11*a* of the insulator 11 and laminated on the electrically conductive glass powder 13 is preparatorily compressed by the pressure rod 51 inserted into the through-hole 11*a* from the rear end of the through-hole 11*a*.

Electrically conductive glass powder 13 shown in Table 1 is injected into the through-hole 11*a* of the insulator 11 again in the same manner as the aforementioned electrically conductive glass powder 13 and the resistor material powder 14. The electrically conductive glass powder 13 disposed in the through-hole 11*a* of the insulator 11 and laminated on the resistor material powder 14 is preparatorily compressed by the pressure rod 51 inserted into the through-hole 11*a* from the rear end of the through-hole 11*a*. On this occasion, the through-hole 11*a* of the insulator 11 is filled with the electrically conductive glass powder 13.

Thus, a powder layer 15 is laminated in the through-hole 11*a* of the insulator 11 and at the rear end of the center electrode 12 so that the electrically conductive glass powder 13, the resistor material powder 14 and the electrically conductive glass powder 13 are arranged in order as the powder layer 15.

Figure 2:
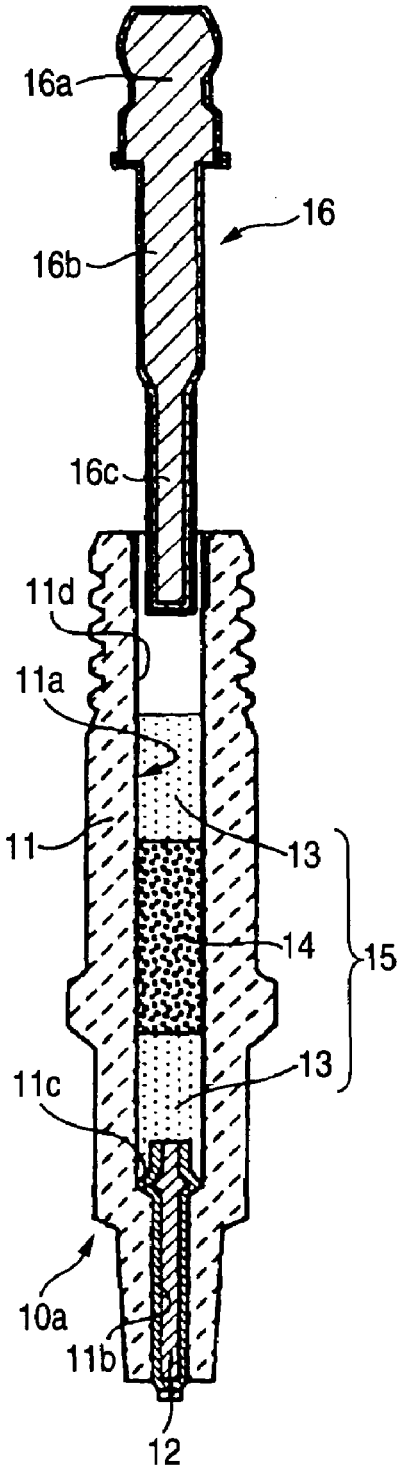
FIG. 2 is a vertical sectional view of an insulator and a terminal attachment in a production process according to an embodiment.
Figure 2:
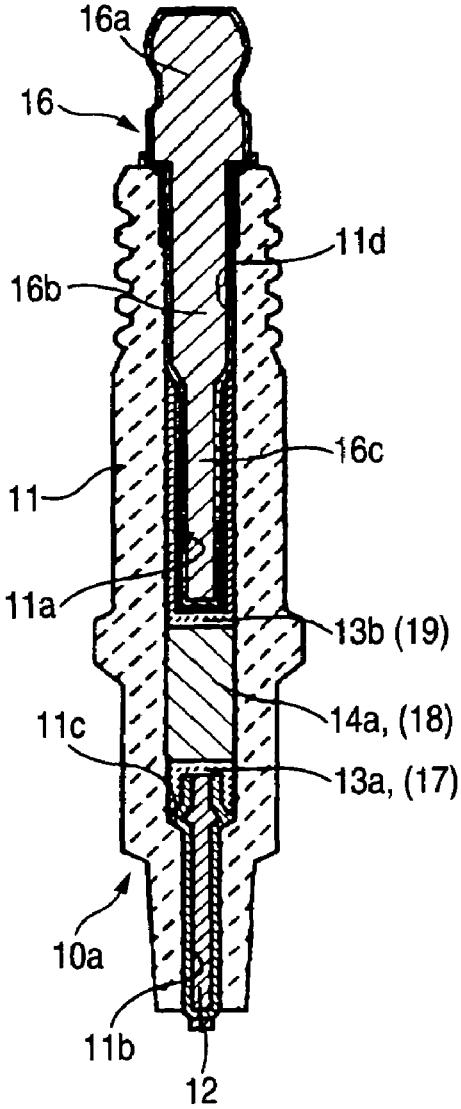

In a spark plug intermediate 10*a* which includes the insulator 11 containing the powder layer 15 laminated as described above, and the center electrode 12, as shown in FIG. 2(*a*), a terminal attachment 16 is inserted into the through-hole 11*a* of the insulator 11 from the rear end of the through-hole 11*a*. After the intermediate 10*a* is heated to soften the power layer 15, the terminal attachment 16 is pressed forward by hot pressing.

The terminal attachment 16 is made of low-carbon steel or the like. The terminal attachment 16 has: a terminal portion 16*a* with an enlarged diameter; a columnar portion 16*b* extending from the terminal portion 16*a* toward the front end and substantially having the same diameter as that of the through-hole 11*a* of the insulator 11; and a rod-like portion 16*c* extending from the columnar portion 16*b* toward the front end and having a diameter smaller than that of the columnar portion 16*b*.

As shown in FIG. 2(*b*), in the through-hole 11*a* of the insulator 11, the electrically conductive glass powder 13 laminated on the rear end of the center electrode 12 is compressed as electrically conductive glass 13*a*. The resistor material powder 14 laminated on the electrically conductive glass powder 13 is compressed as a resistor 14*a*. The electrically conductive glass powder 13 laminated on the resistor material powder 14 is compressed as electrically conductive glass 13*b* in a range surrounded by the circumference of the rod-like portion 16*c* of the terminal attachment 16 and the through-hole 11*a* of the insulator 11.

Thus, the terminal attachment 16 is inserted into the through-hole 11*a* of the insulator 11 while the through-hole 11*a* is sealed with the columnar portion 16*b*, so that the terminal attachment 16 is connected to the rear end of the through-hole 11*a* of the insulator 11 by the terminal portion 16*a*.

The intermediate 10*a* and the terminal attachment 16 are cooled at ordinary temperature. Thus, in the through-hole 11*a* of the insulator 11, a first electrically conductive sealing layer 17 is formed from the electrically conductive glass 13*a* compressed at the rear end of the center electrode 12. A resistor 18 is formed from the resistor 14*a* compressed at the rear end of the electrically conductive glass 13*a*. A second electrically conductive sealing layer 19 is formed from the electrically conductive glass 13*b* compressed at the rear end of the resistor 14*a* so that the second electrically conductive sealing layer 19 is disposed in a range surrounded by the circumference of the rod-like portion 16*c* of the terminal attachment 16 and the through-hole 11*a* of the insulator 11.

Thus, in the through-hole 11*a* of the insulator 11, the center electrode 12 is fixed by the first electrically conductive sealing layer 17 while the terminal attachment 16 is fixed by the second electrically conductive sealing layer 19.

Figure 3:
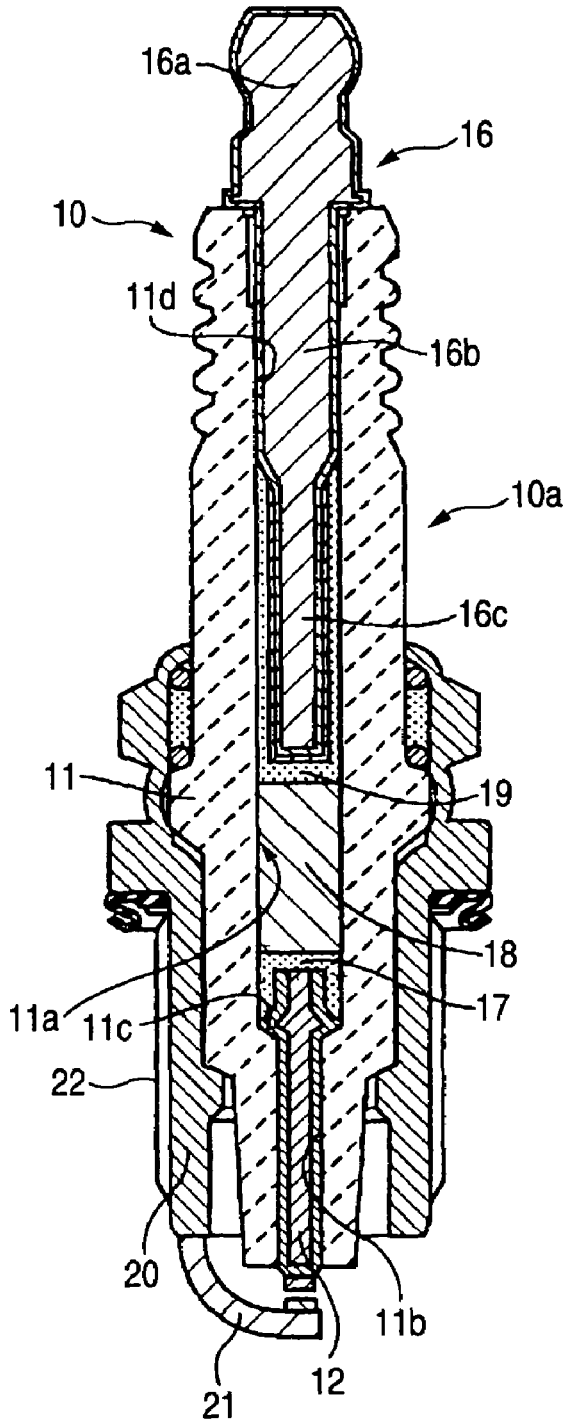
FIG. 3 is a vertical sectional overall view of a spark plug according to an embodiment.

Then, as shown in FIG. 3, a metal shell 20 made of carbon steel or the like is prepared. The metal shell 20 has a threaded portion 22 formed in its outer circumferential surface. The intermediate 10*a* in which the center electrode 12 and the terminal attachment 16 are fixed is inserted into the cylindrical metal shell 20 so as to extend in the axial direction of the metal shell 20. Thus, the spark plug 10 according to this embodiment is produced. The spark plug is used as an engine ignition source for generating spark discharge in a spark discharge gap between the ground electrode 21 and the center electrode 12 after the threaded portion 22 of the metal shell 20 is attached to an engine head or the like of an internal combustion engine not shown.

The spark plug 10 includes the cylindrical metal shell 20, and the insulator 11 extending in the axial direction of the metal shell 20 and fixed to the inside of the metal shell 20. The insulator 11 is formed cylindrically by the through-hole 11*a*. The center electrode 12 and the terminal attachment 16 are provided in the inside of the metal shell 20 and the insulator 11. The center electrode 12 extends in the axial direction of the metal shell 20 and has a dischargeable front end protruding from the front end of the insulator 11, and a rear end fixed into the through-hole 11*a*. The terminal attachment 16 extends in the axial direction of the metal shell 20 and has a rear end protruding from the rear end of the insulator 11, and a front end fixed into the through-hole 11*a*. In the inside of the metal shell 20 and the insulator 11 and between the center electrode 12 and the terminal attachment 16, the first electrically conductive sealing layer 17, the resistor 18 and the second electrically conductive sealing layer 19 are provided in order viewed from the center electrode 12 side. An end of the ground electrode 21 for forming a discharge gap between the center electrode 12 and the ground electrode 21 is fixed to the metal shell 20.

Airtightness of the first and second electrically conductive sealing layers 17 and 19 in each of Test Samples 1 to 25 as described above is measured. For the measurement of airtightness, compressed air of 1.5 MPa is imported into the through-hole 11*a* of the insulator 11 from the center electrode 12 side. A judgment is made as to whether the compressed air is leaked out from a portion which is a junction between the insulator 11 and the terminal attachment 16 and which is on the rear end side of the through-hole 11*a*. Thus, the spark plug 10 without leakage of compressed air is evaluated as ○, the spark plug 10 with compressed air leaked out at a rate not higher than 0.1 ml per minute is evaluated as Δ, and the spark plug 10 with compressed air leaked out at a rate higher than 0.1 ml per minute is evaluated as X. Results thereof are shown in Table 2.

TABLE 2

| Test Sample | Air tightness | Impact Resistance |
|---|---|---|
| 1 | ○ | X |
| 2 | ○ | X |
| 3 | ○ | ◎ |
| 4 | ○ | ◎ |
| 5 | ○ | ◎ |
| 6 | ○ | ○ |
| 7 | ○ | ○ |
| 8 | ○ | Δ |
| 9 | ○ | ○ |
| 10 | ○ | ○ |
| 11 | ○ | ○ |
| 12 | ○ | Δ |
| 13 | ○ | ○ |
| 14 | ○ | ○ |
| 15 | ○ | ○ |
| 16 | Δ | ○ |
| 17 | ○ | ◎ |
| 18 | ○ | ◎ |
| 19 | ○ | ◎ |
| 20 | Δ | ◎ |
| 21 | X | X |
| 22 | X | X |
| 23 | ○ | X |
| 24 | ○ | X |
| 25 | ○ | X |

In the spark plug 10 having the first and second electrically conductive sealing layers 17 and 19 in each of Test Samples 1 to 23 as described above, impact resistance is measured. For the measurement of impact resistance, an impact resistance test defined in JIS B8031 is applied to the spark plug 10 having the first and second electrically conductive sealing layers 17 and 19 in each of Test Samples 1 to 23. On this occasion, the impact resistance test is performed in the condition of vibration amplitude of 22 (mm) and 400 impact cycles (per minute), so that change in electric resistance value generated in the spark plug 10 is measured. Thus, the case where increase in electric resistance value is smaller than 1% is evaluated as ◎, the case where increase in electric resistance value is not smaller than 1% but smaller than 2.5% is evaluated as ○, the case where increase in electric resistance value is not smaller than 2.5% but smaller than 5% is evaluated as Δ, and the case where increase in electric resistance value is not smaller than 5% is evaluated as X. Results thereof are also shown in Table 2.

(Consideration)

As shown in Table 2, in the measurement of airtightness, Test Samples 1 to 15, 17 to 19 and 23 to 25 were ○. Test Samples 16 and 20 were Δ. In the measurement of impact resistance, Test Samples 6, 7, 9 to 11 and 13 to 16 were ○. Test Samples 8 and 12 were Δ. Test Samples 3 to 5 and 17 to 20 were ◎.

Particularly, in the spark plug 10, the first and second electrically conductive sealing layers 17 and 19 are made of electrically conductive glass containing a glass component and a metal component. The metal component is a Cu—Zn alloy containing Cu as a first component, and Zn as a second component. Such a Cu—Zn alloy can keep electrical conductivity and airtightness excellent in accordance with the component ratio. The electrically conductive glass containing the Cu—Zn alloy can suppress peeling from occurring in the boundary between each of the inner circumferential surface of the through-hole 11*a* of the insulator 11, the terminal attachment 16 and the center electrode 12 and the first or second electrically conductive sealing layer 17 or 19. In addition, the electrically conductive glass can suppress cracking, fissuring, etc. from occurring in the first and second electrically conductive sealing layers 17 and 19 per se. For this reason, the spark plug 10 is excellent in impact resistance.

Accordingly, in the spark plug 10, impact resistance can be made more excellent while electrical conductivity and airtightness can be kept excellent.

Each of Test Samples 13 to 15 contains a metal component (Cu—Zn alloy) larger than 30 mass % and smaller than 75 mass %. If the metal component is not larger than 30 mass %, impact resistance of the spark plug 10 is insufficient. If the metal component is not smaller than 75 mass %, it is difficult to keep airtightness because the glass component becomes small. For this reason, when electrically conductive glass contains a metal component larger than 30 mass % and smaller than 75 mass %, electrical conductivity and airtightness of the spark plug 10 can be kept so that impact resistance of the spark plug 10 can be improved.

In each of Test Samples 3 to 7, the aforementioned effect can be confirmed in the case where the amount of the Cu—Zn alloy as a metal component is larger than 10 mass %.

In Test Samples 9 to 11, the Cu—Zn alloy contains 5-40 mass % of Zn. The aforementioned effect can be confirmed in the Cu—Zn alloy containing 5-40 mass % of Zn.

Particularly, in each of Test Samples 17 to 19, impact resistance can be improved more greatly while electrical conductivity of the first and second electrically conductive sealing layers 17 and 19 can be kept because the $SnO_2$ content as a semiconductor inorganic oxide is smaller than 10 parts by mass when the sum of the contents of the glass component and the metal component is 100 parts by mass. Incidentally, if the $SnO_2$ content is not smaller than 10 mass %, airtightness is lowered.

In this respect, when the second component of the metal component in each of Test Samples 19 and 20 is changed to Sn, neither airtightness nor impact resistance is improved. When the second component of the metal component in each of Test Samples 21 to 23 is changed to Al or Ni, impact resistance is not improved though airtightness is improved.

Next, in the condition that the mean particle size of the metal powder in Test Sample 3 described above is changed to 8 μm, 10 μm, 36 μm and 50 μm, impact resistance is measured. The measurement of impact resistance is performed in the same manner as the aforementioned method, so that change in electric resistance value generated in the spark plug 10 is measured. Results thereof are shown in Table 3.

TABLE 3

| Test Sample | Amount of Glass Powder Added (mass %) | Amount of Metal Powder Added (mass %) | Composition of Metal Powder | Amount of Cu—10Zn Added (mass %) | Particle Size of Glass Powder (μm) | Particle Size Of Metal Powder (μm) | Impact Resistance |
|---|---|---|---|---|---|---|---|
| 26 | 50 | 50 | Cu—10Zn | 100 | 100 | 8 | ○ |
| 27 | 50 | 50 | Cu—10Zn | 100 | 100 | 10 | ○ |
| 28 | 50 | 50 | Cu—10Zn | 100 | 100 | 36 | ○ |
| 29 | 50 | 50 | Cu—10Zn | 100 | 100 | 50 | Δ |

As shown in Table 3, in the measurement of impact resistance, Test Samples 26 to 28 were ○. Accordingly, it is proved that the spark plug 10 having the first and second electrically conductive sealing layers 17 and 19 in each of Test Samples 26 to 28 has excellent impact resistance.

Although the spark plug 10 according to this embodiment has the resistor 18, the spark plug 10 may not have any resistor 18. Although the spark plug 10 has the first and second electrically conductive sealing layers 17 and 19, the spark plug 10 may have either of the first and second electrically conductive sealing layers 17 and 19.

An Ni plating layer about 5 μm thick may be formed on the surface of the terminal attachment 16. The circumference of the rod-like portion 16*c* of the terminal attachment 16 may be covered with a metal layer mainly containing one member or two or more members selected from Zn, Sn, Pb, Rh, Pd, Pt, Cu, Au, Sb and Ag. This is because bonding strength between the terminal attachment 16 and the second electrically conductive sealing layer 19 can be enhanced.

Although the present invention has been described in detail and with reference to a specific embodiment thereof, it is obvious to those skilled in the art that various changes and modifications may be made without departing from the spirit and scope of the invention.

This application is based on Japanese Patent Application (Patent Application No. 2003-142415) filed on May 20, 2003 and the contents thereof are taken in by reference.

INDUSTRIAL APPLICABILITY

According to the invention, there can be obtained a spark plug which has more excellent impact resistance with electrical conductivity and airtightness kept excellent, and a method for producing the same.

The invention claimed is:

1. A spark plug comprising: an insulator having a through-hole formed in an axial direction; a terminal attachment disposed on one end side of said insulator; a center electrode disposed on other end side of said insulator; and an electrically conductive connection layer disposed in said through-hole for electrically connecting said terminal attachment and said center electrode to each other, said electrically conductive connection layer including at least one electrically conductive sealing layer connected to at least one of said terminal attachment and said center electrode, wherein said electrically conductive sealing layer is made of electrically conductive glass containing a glass component and a metal component, the metal component being in an amount larger than 30 mass% and smaller than 75 mass% of the electrically conductive glass, and the metal component comprising Cu—Zn alloy in an amount of larger than 10 mass% of the metal component.

2. The spark plug as claimed in claim 1, wherein substantially all of the Zn contained in said metal component is alloyed.

3. A spark plug comprising: an insulator having a through-hole formed in an axial direction; a terminal attachment disposed on one end side of said insulator; a center electrode disposed on other end side of said insulator; and an electrically conductive connection layer disposed in said through-hole for electrically connecting said terminal attachment and said center electrode to each other, said electrically conductive connection layer including at least one electrically conductive sealing layer connected to at least one of said terminal attachment and said center electrode, wherein said electrically conductive sealing layer is made of electrically conductive glass containing a glass component and a metal component, and the metal component comprises Cu—Zn alloy in an amount of larger than 50 mass% of the metal component.

4. The spark plug as claimed in claim 3, wherein substantially all Zn contained in said metal component is alloyed.

5. A method for producing a spark plug including an insulator having a through-hole formed in an axial direction, a terminal attachment disposed on one end side of said insulator, a center electrode disposed on other end side of said insulator, and an electrically conductive connection layer disposed in said through-hole for electrically connecting said terminal attachment and said center electrode to each other, said electrically conductive connection layer including at least one electrically conductive sealing layer connected to at least one of said terminal attachment and said center electrode, said method comprising the steps of: filling said through-hole of said insulator with electrically conductive glass powder containing glass powder and metal powder, the metal powder containing Cu—Zn alloy powder in an amount of larger than 10 mass % of the metal powder; and softening said electrically conductive glass powder to form said electrically conductive sealing layer, wherein said electrically conductive glass powder contains said metal powder in an amount larger than 30 mass % and smaller than 75 mass % of the electrically conductive glass powder.

6. The method for producing a spark plug as claimed in claim 5, wherein said metal powder contains said Cu—Zn alloy powder in an amount of larger than 50 mass % and smaller than 75 mass % of the metal powder.

7. The method for producing a spark plug according to claim 5, wherein said metal powder does not contain any non-alloyed Zn powder.

8. The method for producing a spark plug as claimed in claim 5, wherein said Cu—Zn alloy powder contains Zn in an amount of 5 to 40 mass % of the Cu—Zn alloy powder.

9. The method for producing a spark plug as claimed in claim 5, wherein said electrically conductive glass powder contains a semiconductor inorganic oxide, said semiconductor inorganic oxide comprising at least one member selected from the group consisting of In, Sn, Cr, V and Ti.

10. The method for producing a spark plug as claimed in claim 9, wherein said electrically conductive glass powder contains said semiconductor inorganic oxide in an amount smaller than 10 parts by mass when a total amount of said glass powder and said metal powder is 100 parts by mass.

11. The method for producing a spark plug as claimed in claim 5, wherein the mean particle size of said metal powder is not smaller than 5 μm and not larger than 40 μm.

12. A method for producing a spark plug including an insulator having a through-hole formed in an axial direction, a terminal attachment disposed on one end side of said insulator, a center electrode disposed on other end side of said insulator, and an electrically conductive connection layer disposed in said through-hole for electrically connecting said terminal attachment and said center electrode to each other, said electrically conductive connection layer including at least one electrically conductive sealing layer connected to at least one of said terminal attachment and said center electrode, said method comprising the steps of: filling said through-hole of said insulator with electrically conductive glass powder containing glass powder and metal powder, the metal powder containing Cu—Zn alloy powder in an amount of larger than 50 mass % of the metal powder; and softening said electrically conductive glass powder to form said electrically conductive sealing layer.

13. The method for producing a spark plug according to claim 12, wherein said metal powder does not contain any non-alloyed Zn powder.

14. The method for producing a spark plug as claimed in claim 12, wherein said Cu—Zn alloy powder contains Zn in amount of 5 to 40 mass% of the Cu—Zn alloy powder.

15. The method for producing a spark plug as claimed in claim 12, wherein said electrically conductive glass powder contains a semiconductor inorganic oxide, said semiconductor inorganic oxide comprises at least one member selected from the group consisting of In, Sn, Cr, V and Ti.

16. The method for producing a spark plug as claimed in claim 15, wherein said electrically conductive glass powder contains said semiconductor inorganic oxide in an amount smaller than 10 parts by mass when a total amount of said glass powder and said metal powder is 100 parts by mass.

17. The method for producing a spark plug as claimed in claim 12, wherein the mean particle size of said metal powder is not smaller than 5 μm and not larger than 40 μm.

* * * * *